US005869932A

United States Patent [19]

Choi

[11] Patent Number: 5,869,932

[45] Date of Patent: Feb. 9, 1999

[54] AUTOMATIC ILLUMINATING APPARATUS OF WASHING MACHINE AND CONTROL CIRCUIT THEREOF

[75] Inventor: Ssi Chol Choi, Suwon, Rep. of Korea

[73] Assignee: Samsung Electronics Co., Ltd., Suwon, Rep. of Korea

[21] Appl. No.: 714,682

[22] Filed: Sep. 16, 1996

[30] Foreign Application Priority Data

Sep. 18, 1995 [KR] Rep. of Korea ..... 1995-30448
Oct. 13, 1995 [KR] Rep. of Korea ..... 1995-35397

[51] Int. Cl.[6] ..... F21V 33/00

[52] U.S. Cl. ..... 315/76; 315/84; 68/12.27; 362/89

[58] Field of Search ..... 439/519, 521, 439/9, 10; 362/89, 91, 101, 154, 155, 156, 310, 311; 315/76, 84; 359/487; 68/12.27

[56] References Cited

U.S. PATENT DOCUMENTS 3,743,380 7/1973 Fugitt ..... 359/487
3,916,652 11/1975 Speakman ..... 68/13 R

FOREIGN PATENT DOCUMENTS 6-190186 7/1994 Japan .

*Primary Examiner*—Don Wong
*Assistant Examiner*—David H. Vu
*Attorney, Agent, or Firm*—Burns, Doane, Swecker & Mathis, L.L.P.

[57] ABSTRACT

A clothes washing machine includes a body, a tub within the body, a cover for the body, and an illumination device for illuminating an interior of the body. The illumination device includes a downwardly depending socket having a lamp mounted therein; and a case encompassing the lamp and forming a water-tight seal with the socket. Light is emitted from a lower end of the case, which is covered by a light-concentrating lens. The lamp is energized by a secondary coil of a transformer and is turned on and off by a switch. The lamp is turned on when the cover is open. Another secondary coil of the transformer supplies power to a microcomputer which operates the switch.

4 Claims, 5 Drawing Sheets

AUTOMATIC ILLUMINATING APPARATUS OF WASHING MACHINE AND CONTROL CIRCUIT THEREOF

BACKGROUND OF THE INVENTION (1) Field of the Invention

The present invention relates to an automatic illuminating apparatus of a washing machine and a control circuit thereof.

(2) Description of the Prior Art

Generally, an illuminating apparatus is installed into a washing machine, thereby facilitating inserting and removing of the laundry. That is, even though a cover of the washing machine is opened at a not illuminated location, the inside of the washing machine can be seen by the user because an illuminating lamp is mounted to a lower part of a top cover of the washing machine.

A conventional art has been described in Japanese Utility Model Sho. 64-55888, published on 6 Apr. 1989, entitled 'A WASHING MACHINE'. The conventional art relates to a washing machine comprising: a washing tub; an operating panel installed to an upper part of the washing tub; a neon lamp installed in the operating panel; and a transparent plate that permeates light of the neon lamp into the washing tub.

Herein, as for an illuminating apparatus of the conventional art, the lamp is installed in the operating panel, light illuminates the washing tub through the lamp, and the lamp is directly connected to an alternating current (AC) power-supply.

Accordingly, the lamp has a simple structure in the conventional art, and its lighting-up can be controlled. However, a counterplan for preventing water leakage is not suggested in a structure of the lamp, so that there is a possibility of danger of short-circuiting in the conventional art. Since the power-supply of the neon lamp is the AC power-supply commonly used for a load such as a pulsator motor, the conventional art causes a fatal danger to the user when a short circuit occurs.

The current washing machine commonly has a controller comprised of a microprocessor. The controller makes the washing machine perform a washing procedure (i.e., washing→rinsing→drain→spin drying) according to a predetermined program. The controller controls both a displayer showing the operating state of a system and an illuminating apparatus illuminating the inside of the washing machine.

Another conventional art regarding the above washing machine having such a controller, has been described in Japanese Patent application Hei. 6-190186, published on 12 Jul. 1994, entitled 'A WASHING MACHINE'.

A washing machine according to another conventional art includes: an illuminating lamp for illuminating the inside of a washing machine; a clear window mounted to a top cover, for seeing the inside of the washing machine; and an opening/closing sensor for determining whether the top cover is opened or closed. When the opening/closing sensor determines that the top cover is open, the washing machine turns on the illuminating lamp. When the opening/closing sensor determines that the top cover is closed, the washing machine turns off the illuminating lamp after the lapse of a predetermined time.

Such washing machine has one direct current (DC) power-supply. The DC power-supply is supplied to a controller, a displayer, and a lamp. Accordingly, when the lamp is turned on, a current for driving the displayer relatively decreases. Worst of all, even the brightness of the lamp decreases, so that the user has difficulty seeing an operating state of the washing machine. In addition, in case of a short circuit of the lamp, it may cause an electric shock to the user.

SUMMARY OF THE INVENTION

Accordingly, the present invention is directed to an automatic illuminating apparatus of a washing machine and a control circuit thereof that substantially obviate one or more of the problems of the related art.

An object of the present invention is to provide an automatic illuminating apparatus of a washing machine and a control method thereof which safely operates an illuminating lamp.

Another object of the present invention is to provide an automatic illuminating apparatus of a washing machine and a control method thereof including an illuminating lamp having a sealing structure to prevent water leakage, thereby preventing a short circuiting of the illuminating lamp.

Still another object of the present invention is to provide an automatic illuminating apparatus of a washing machine and a control method thereof wherein an illuminating lamp uses an additional power-supply, thereby obviating a problem caused by a power-supply commonly used to various parts.

In order to achieve these objects and others, the present invention which is installed to a top of a body so as to automatically illuminate the inside of the body, includes:

an illuminating apparatus: and
- a socket for housing a lamp;
- socket supporting means for properly fixing the socket to the top cover; and
- an illuminating case an upper part of which is connected to the socket supporting means, and a lower part which has a lens for maximizing illumination of the lamp; and a controller for controlling the illuminating apparatus to be automatically turned on and off.

The controller includes:

self-power supply means;

power supply means for supplying a driving current to the lamp;

sensing means for sensing opening/closing of the top cover;

driving means for driving the lamp;

displaying means for displaying a driving state of a system; and microprocessor which turns on or off the lamp according to an opening/closing sensing signal of the top cover from the sensing means.

As a result, the present invention provides a leak-proof illuminating apparatus which illuminates the inside of the washing machine. In addition, the present invention applies an additional power-supply voltage to a lamp in the illuminating apparatus, thereby eliminating a possibility of an electric shock due to a dielectric breakdown.

BRIEF DESCRIPTION OF THE DRAWINGS

The preferred embodiment of the present invention will now be described more specifically with reference to the attached drawings, wherein.

DETAILED DESCRIPTION OF THE PREFERRED EMBODIMENT

The preferred embodiment of the present invention will become apparent from a study of the following detailed description, when viewed in light of the accompanying drawings.

Figure 1:
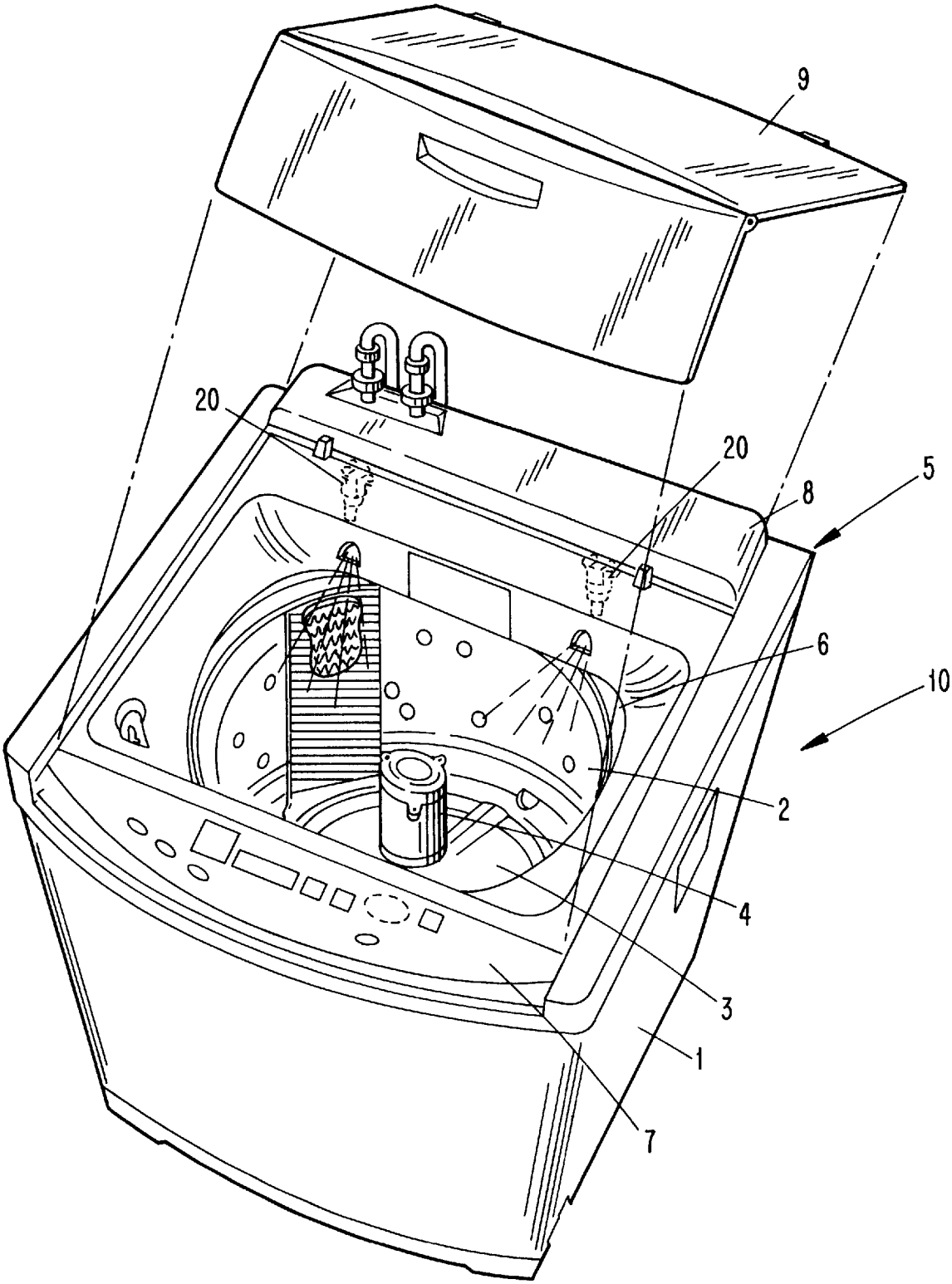
FIG. 1 is a top perspective view illustrating a washing machine having an illuminating apparatus in accordance with a preferred embodiment of the present invention.

FIG. 1 shows a fully automatic washing machine according to the present invention. The fully automatic washing machine 10 includes a body 1. A water tub and a washing tub are installed in the body 1. Only the washing tub 2 is shown in FIG. 1. Since a pulsator 3 is connected to a power transmitter (not shown), the pulsator 3 rotates. An eddy current generating cam 4 which rotates concurrently with the pulsator 3 is disposed in a central part of the washing tub 2. A top structure 5 is installed to an upper part of the body 1. The top structure 5 has an injection hole 6 for admitting laundry into the washing tub 2. A control panel 7 is installed to the front of the top structure 5, thereby receiving an external input from the user and an operation of a system. A rear part of the top structure 5 is a box 8. Illuminating lamp apparatuses 20 are installed in a lower part of the box 8. One end of the top cover 9 is fixed to the box 8. Additional components of the washer will not be described below because they are well known to those skilled in the art to which this invention pertains. Herein, the illuminating lamp apparatus 20 effectively illuminates the inside of the washing tub 2, and has a sealing structure to prevent water leakage, as shown in FIGS. 2 and 3.

Figure 2:
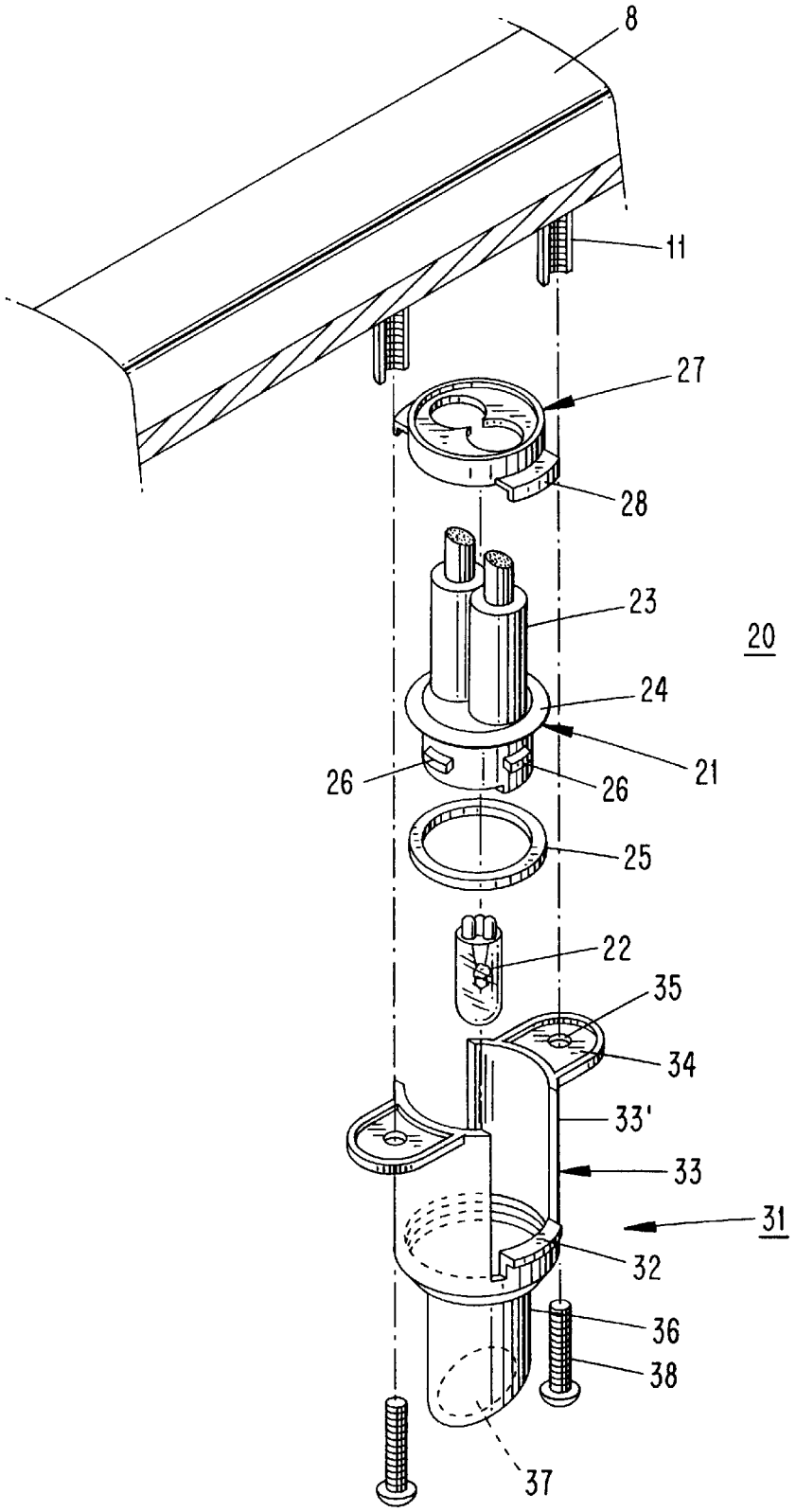
FIG. 2 is an exploded perspective view illustrating the illuminating apparatus in accordance with a preferred embodiment of the present invention.
Figure 3:
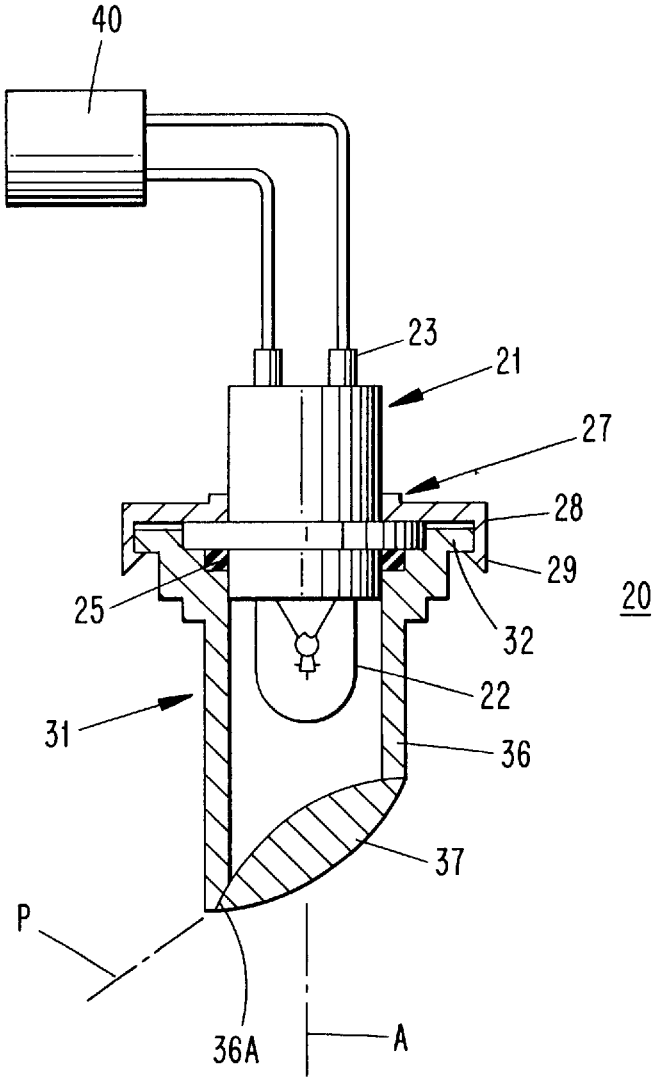
FIG. 3 is a cross-sectional view of the illuminating apparatus in accordance with a preferred embodiment of the present invention.

Referring to FIGS. 2 and 3, the illuminating lamp apparatus 20 includes: a socket 21 which is coupled with a lamp 22, and has a terminal portion 23 for supporting an electric wire which projects from the box 8; and a supporting member 27 which supports the terminal portion 23. The member 27 has hook portions 28 for supporting the socket 21 or an illuminating case 31.

A flange 24 which extends along a top circumference of the socket 21. A sealing ring 25 made of rubber is positioned at the bottom of the flange 24. A plurality of projections 26 are positioned at a lower part of the flange 24. The illuminating case 31 is of a cylindrical shape. The illuminating case 31 houses the lamp 22 in its internal hole, and makes possible to illuminate the outside. The internal upper part of the illuminating case 31 is a step-like structure, so the illuminating case 31 bears against the sealing ring 25 and the flange 24. A hanging portion 32 extends to the outside from an upper part of the illuminating case 31 in order to be connected to the hook portion 28. A bracket 33 is formed to house the terminal 23 of the socket 21. In other words, the bracket 33 includes: a body; a supporting portion 33' whose height is similar to that of the terminal portion 23; and a case fixing member 34 which extends laterally outwardly from an upper part of the supporting portion 33'.

A screw hole 35 is formed in a central part of the case fixing member 34, so that a screw can be inserted therein.

A cylinder 36 having a constant length extends at the lower part of the illuminating case 31. A shape of the lower edge 36A of the cylinder 36 is an oblique shape, i.e., the edge 36A lies in a plane P, extending obliquely relative to a central axis A of the case. An illuminating lens 37 such as a convex lens is fixed to the lower part of the cylinder 36. As a result, the light emitted from the lamp 22 is illuminated as an oblique shape, so that the inside of the washing machine is effectively illuminated.

Fixing means 11 such as a nut, for receiving the screw 38, is installed in a lower part of the box 8.

Accordingly, in the illuminating lamp apparatus 20, the supporting member 27 is positioned on the socket 21, the lamp 22 is inserted into the socket 21. At this time, in the illuminating case 31, the hanging portion 32 is hooked on hooks 29 of the hook portion 28 and the upper part, being a step-like structure, bears against the sealing ring 25. Finally, the fixing member 34 of the bracket 33 is fixed to the fixing means 11 of the box 8, so the illuminating apparatus 20 is completely assembled.

Figure 4:
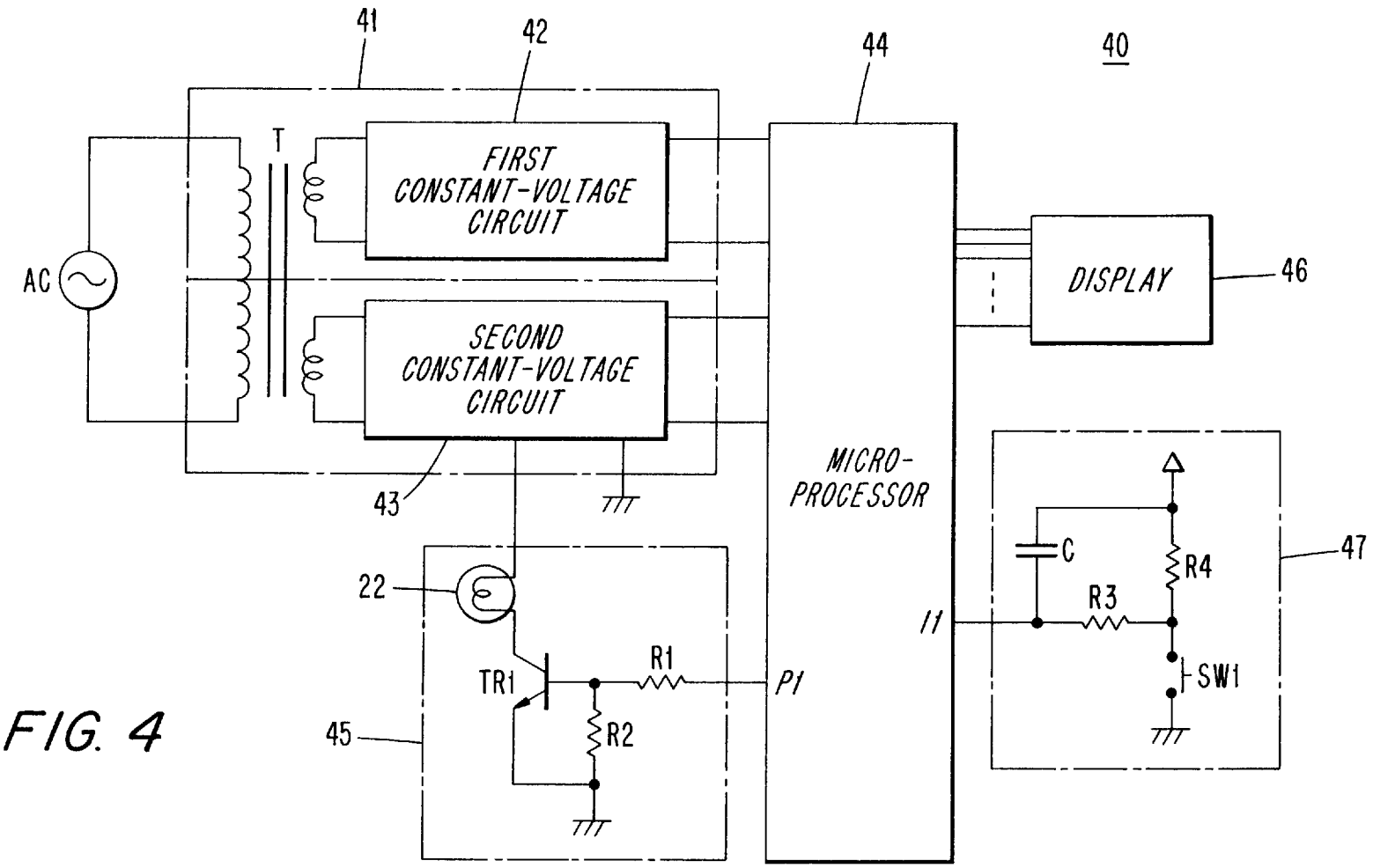
FIG. 4 is a block diagram illustrating a controller of the illuminating apparatus in accordance with a preferred embodiment of the present invention.
Figure 5:
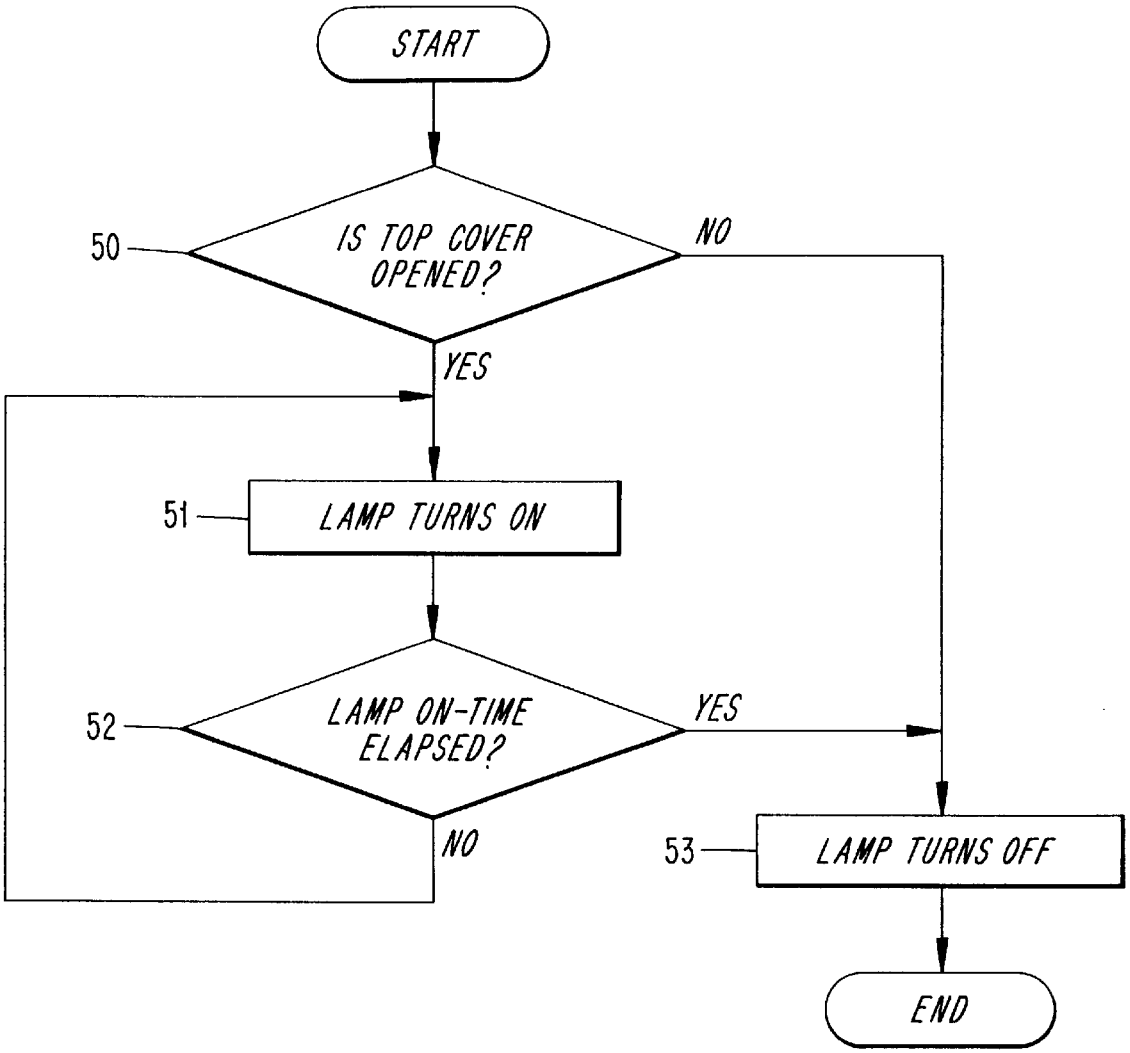
FIG. 5 is a flow chart of a controller of the illuminating apparatus in accordance with a preferred embodiment of the present invention.

The aforementioned illuminating apparatus 20 is controlled by using a controller 40 shown in FIGS. 4 and 5. As shown in FIG. 4, the controller 40 has a power-supply means 41 which includes: a transformer T connected to a primary coil of an AC power-supply AC; and first and second constant-voltage circuits 42 and 43 connected to each secondary coil of the transformer T. At this time, since two transformers respectively comprised of the primary and secondary coils are used, they can be respectively connected to the first and second constant-voltage circuits 42 and 43.

Herein, the first constant-voltage circuit 42 generates a voltage used as a DC power-supply of the controller 40, so that the second constant-voltage circuit 43 generates a supply voltage for the lamp 22 of the illuminating apparatus 21 according to a principle of the present invention. The controller 40 has a microcomputer 44 which includes: driving means 45 for driving the lamp 22; a sensor 47 for sensing the opened/closed state of a cover 9; and a display 46 which displays both an illuminated state of the lamp 22 and a driving state of the system. The driving means 45 is comprised of a transistor TR1 whose base is connected to an output terminal P1 of the microcomputer 44 through a resistor R1. An emitter of the transistor TR1 is grounded. A stabilizing resistor R2 has one end connected between the base of the transistor TR1 and the resistor R1 and another end which is grounded. A collector of the transistor TR1 is connected to the first constant-voltage circuit 43 through the lamp 22. As a result, when the transistor TR1 is turned on, the lamp 22 is turned on. In this case, a relay can be used instead of the transistor TR1.

The sensor 47 has a switch SW1 for sensing the open/closed state of the cover. The switch SW1 is connected to a power-supply through a resistor R4, and is connected to an input terminal I1 of the microcomputer 44 through a resistor R3. The condenser C is an AC filler capacitor in which one end is connected to the power-supply and the other end is connected between the input terminal I1 and the resistor R3.

In the meantime, as shown in FIG. 5, the microcomputer 44 controls the on/off state of the lamp 22.

Step 50 determines whether the cover 9 is opened, and goes to Step 53 if the cover 9 is not opened, thereby maintaining an OFF-state of the lamp 22. On the contrary, if the cover 9 is open, the microcomputer 44 turns on the lamp 22 in a step 51, thereby illuminating the inside of the washing machine. Thereafter, an internal timer counts a lapse of a predetermined time. A step 53 determines whether the predetermined time is elapsed. When the predetermined time is elapsed, the lamp 22 is turned off.

As described above, the present invention illuminates the inside of the washing machine by automatically turning on the lamp of the illuminating apparatus, thereby facilitating in inserting of the laundry. Furthermore, the illuminating apparatus of the present invention has a waterproof structure, thereby eliminating a malfunction due to water leakage. In particular, a driving power-supply applied to the lamp is additionally provided in addition to a system power-supply, thereby simultaneously eliminating a dangerous electrical shock due to a dielectric breakdown of the lamp, and a bad electrical effect of the system caused by the lamp.

What is claimed is:

1. A clothes washing machine, comprising:

a body;

a tub within the body;

a cover attached to the body; and an illuminating device attached near a rear portion of the body for illuminating an interior of the body, the illuminating device including:

a socket including an opening at a front end of the socket receiving a lamp, a case extending forwardly past the opening and the lamp and surrounding the opening and the lamp, a rear end of the case forming a seal with the socket to resist leakage of water into the opening from between the socket and case, a front end of the case emitting light to the interior of the housing, the front end of the case terminating in an edge lying in a plane extending obliquely with respect to an axis of the case, a light-transmitting lens extending across the front end of the case for concentrating the transmitted light, the lens lying in the obliquely extending plane so that light is emitted obliquely with respect to the axis, and a sealing ring pressed between a forwardly facing surface of the socket and a rearwardly facing surface of the case, the sealing ring disposed internally of the case.

2. The clothes washing machine according to claim 1, further including a supporting member for attaching the socket to the case.

3. The clothes washing machine according to claim 2 wherein the supporting member includes hooks which engage in front of a portion of the case and keep the case pressed against the socket.

4. The clothes washing machine according to claim 1 wherein the illumination device projects downwardly from an upper portion of the body.

* * * * *